United States Patent [19]

Mastriani

[11] 4,266,737

[45] May 12, 1981

[54] AIR DIFFERENTIAL MANDREL AND METHOD OF DIFFERENTIALLY WINDING AND REWINDING TAPES

[75] Inventor: Elvin A. Mastriani, Roseland, N.J.

[73] Assignee: Arrow Converting Equipment, Inc., Fairfield, N.J.

[21] Appl. No.: 91,504

[22] Filed: Nov. 5, 1979

[51] Int. Cl.[3] ..... B65H 75/24; B65H 19/04

[52] U.S. Cl. ..... 242/72 B; 242/56.9

[58] Field of Search ..... 242/72 B, 72, 56.2, 242/56.3, 56.4, 56.5, 56.6, 56.7, 56.9, 621 R

[56] References Cited

U.S. PATENT DOCUMENTS

| | | | |
|---|---|---|---|
| 1,297,809 | 3/1919 | Dixon | 242/72 B |
| 2,062,421 | 12/1936 | Lindbom | 242/72 B |
| 3,006,152 | 10/1961 | Rusche | 242/72 B X |
| 3,878,999 | 4/1975 | Daves | 242/56.9 |
| 3,904,143 | 9/1973 | Kullander | 242/72 B |
| 3,904,144 | 9/1975 | Gattrugeri | 242/72 B |
| 3,945,583 | 3/1976 | Ochs | 242/56.9 |

*Primary Examiner*—Edward J. McCarthy
*Attorney, Agent, or Firm*—Harry Sommers

[57] ABSTRACT

An air-controlled differential rewind mandrel for simultaneously winding multiples of web material (referred to hereinafter as slit strips) mounted onto cores provided in slitting and rewind machines with two or more rewind mandrels, and means for providing constant torque to each rewinding roll formed by the individual slit strips.

36 Claims, 16 Drawing Figures

FIG. 11
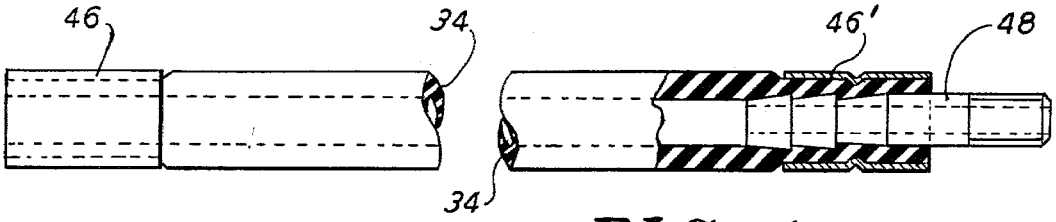
FIG. 11a
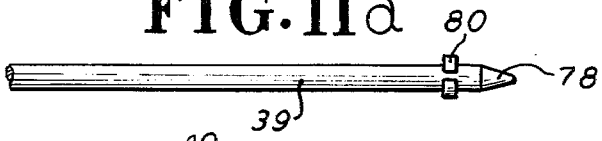
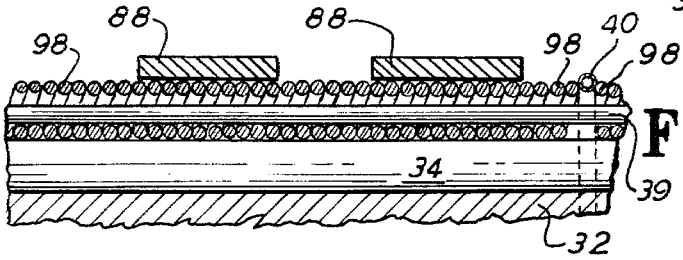
FIG. 12
FIG. 13
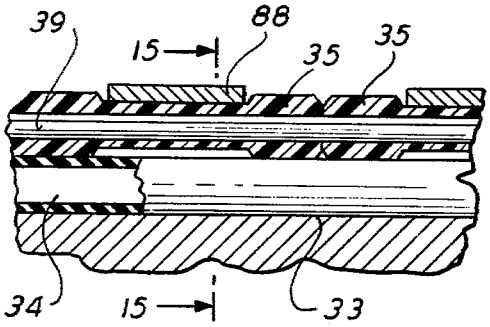
FIG. 14
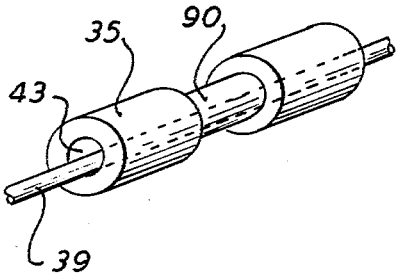
FIG. 15
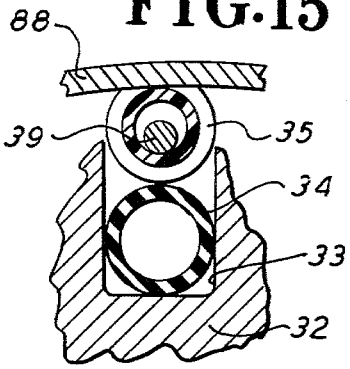
FIG. 16
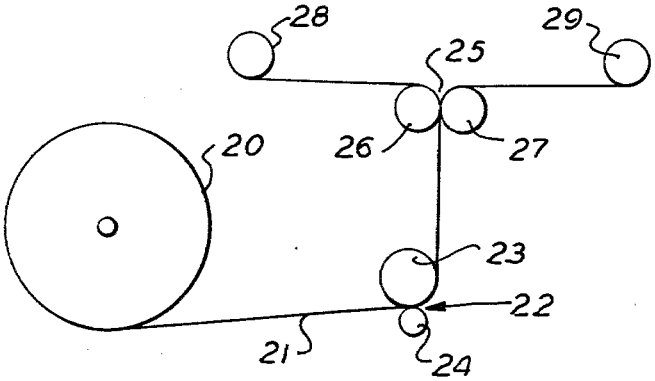

AIR DIFFERENTIAL MANDREL AND METHOD OF DIFFERENTIALLY WINDING AND REWINDING TAPES

PRIOR ART PRACTICES

A variable factor which affects the simultaneous rewinding of multiple slit strips on two or more mandrels is the inherent variation in thickness of web material measured in a transverse direction (90° to travel of the web).

The condition causes the rewinding roll to vary in diameter proportional to the thickness of the web in each roll. In order to compensate for this variation, the rewinding cores are allowed to slip on the mandrels so that each core rotates at the speed required to wind the roll. This is accomplished by assembling the cores alternately with keyed rings or spacers. A keyway on the mandrel compels the spacers to rotate at the same revolution as the mandrel, but nevertheless the assemblage of cores and spacers are permitted to move freely in an axial direction.

By end loading the mandrels by means of spring or air pressure, it is possible to vary the rewinding torque and thereby the hardness of the rewinding rolls.

Normally, a winding machine is provided with two spaced rewind mandrels, each mandrel carrying a plurality of alternately-disposed cores and spacer rings. Adjacently-disposed strips of the slit web are directed to different mandrels so that the spacing of the cores on each mandrel is equal to the width of the strips. Such spacing is maintained by the core spacers.

The cores on which the slit strips are wound are formed of several layers of heavy paper wound into a rigid tube. The cores are then cut into the desired widths to match the width of the slit strips. It is evident, given the material from which the core is made that the tolerance of the length of the cut core cannot be held to a precise limit. Consequently, the assemblage of cores and spacers may be subject to cummulative dimensions which result in the misalignment between cores and slit strips. This condition is called "off-core" and may cause defects in the winding of the rolls.

Another inherent disadvantage in this method is that the rewinding torque is created by end loading the assemblage of cores and spacers which results in a significant variation in the magnitude of torque across the stack. This phenomenon is called "decay" of torque as the end load is affected by the lateral friction of the assemblage of cores and spacers.

This condition makes it difficult to wind materials such as thin plastic films which require precise torque control.

In order to overcome the problems of varying torque caused by axial loading, several prior art devices have attempted to utilize radial loading by means of fluid pressure or springs. Such devices have proven to be cumbersome and in addition require different mandrels for each slit width pattern resulting in an excessive investment of equipment.

Another disadvantage of the conventional method is the excessive amount of time required to remove a finished set of rewind mandrels from the mandrels, and prepare the mandrel for the next cycle. It is necessary to remove a spacer between adjacent rolls and then reassemble the core and spacer assembly which is time consuming.

OBJECTS OF THE PRESENT INVENTION

This invention provides a mandrel which differentially rewinds slit strips by applying a radial load to each core rather than axial loading as described in Prior Art Practices above. Since interaction between adjacent cores and spacers as caused by axial loading is eliminated, a degree of preciseness of torque is obtained not possible in prior art, with resultant ability to wind rolls to the proper hardness required.

Another advantage of this invention is that the cores are located in the exact location required by means of interchangeable "tooling" consisting of "spools" which are mounted on rods. The spools are made of tubular material generally twice the width of the core. The external diameter of the spool is reduced for a width equal to the width of the core thereby forming a position into which the core locates. The internal diameter of the spools is considerably larger than the diameter of the rods on which they are assembled allowing the spools to "float" on the rod.

The rewind mandrels are generally provided with four spool roll assemblies, equally spaced about periphery of the mandrel in grooves of keyways. Inflatable rubber tubes are located under each spool rod assembly and by varying the fluid pressure in the rubber tubes, the amount of torque transmitted to each core will vary in proportion.

To unload the finished rolls off the mandrel, it is necessary only to deflate the rubber rubber tubes and the finished rolls are quite easily slipped off.

The reduced outside diameters of the central portion of each spool forms the positive location of each new core as it is slipped onto the mandrel for the next rewinding cycle.

A further advantage of this invention is that the spool rod assemblies which are provided for each slit width pattern may be easily and quickly changed for other slit width patterns which in addition greatly reduced the investment as opposed to other methods for radial loading which require a completely different set of mandrels for each slit width as described above.

A further advantage of this invention is that by means of utilizing a rotary coupling on the slitter-rewinder to inject fluid continuously, it is possible to vary the fluid pressure during the rewinding cycle to vary the rewinding torque as required by the material being processed.

DESCRIPTION OF THE DRAWINGS

In the drawings, wherein like parts are similarly numbered:

FIG. 11 is a vertical elevational, partly sectional, view of an air differential pneumatic tube of the invention, FIG. 11*a* is a fragmentary elevational, (partly broken) view of a spool or sleeve aligner rod of the invention, (positioned in a sleeve which is shown sectionally,)

FIG. 12 is a fragmentary vertical sectional view of a further form of spool or sleeve comprising a spiral spring 98 positioned on rod 39, whereon tape-winding cores may be positioned, pursuant to the invention, taken at the position 11 of FIG. 1, FIG. 13 is a partly sectional and fragmentary view, taken at line 13—13 of FIG. 2, showing tape winding cores positioned on core holder spools or sleeves pursuant to the invention, FIG. 14 is a partly fragmentary perspective view of a spool or sleeve having an aligner rod of the invention positioned therein, FIG. 15 is a schematic, vertical, sectional view taken at line 15—15 of FIG. 13, and FIG. 16 is a schematic view of a typical web winding apparatus with which the air differential mandrel of the invention may be used.

DESCRIPTION OF PREFERRED EMBODIMENTS

Figure 1:
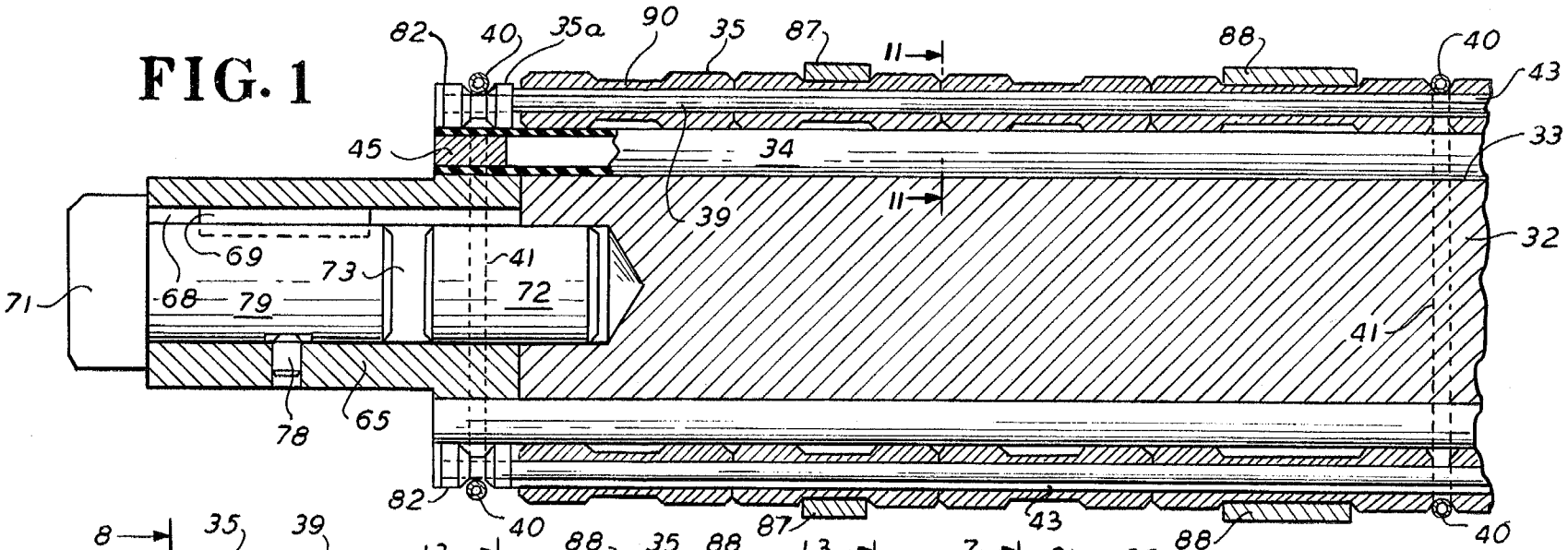
FIG. 1 is a longitudinal sectional view of an end portion of a mandrel embodying the invention.

The air differential mandrel of the invention rewinds tapes from a web source of plastics, paper, textiles, foils, and other materials suitable for rewinding onto spools on a mandrel. By way of example, and without limitation thereto, FIG. 16 schematically shows a typical example of an application of the invention, wherein web 21 is fed from a source roll, such as 20, through a slitting station 22, having an idler or back-up roll 24 and knives or slitters 23 slitting the web 21 into parallel tapes, which are moved as at 25, over idler rolls 26, 27 and then to tape rewinding mandrels 28, 29. Each mandrel, such as indicated at 28, 29 (FIG. 16) without limitation thereto, rewinds alternate tapes cut from the web 21, shown schematically in FIG. 16 as a convenient form of operation of the invention. The invention is adapted for use in any other procedure or operation in which tapes are slit and fed onto one or more mandrels.

The mandrel embodying a preferred embodiment of the invention comprises (FIGS. 1, 2, 8, 12) an elongated mandrel body 32, preferably of circular or other cross-sectional form, and having formed therein a plurality of preferably equidistantly spaced outwardly radially directed and opening slotted portions 33, formed therein of the number desired. They are examplarily shown in the drawings as spaced apart 90° (FIG. 8) but may be spaced apart in any other desired spatial arrangement desired; for example and without limitation thereto, they may be spaced apart a smaller or greater number of degrees. Flexible expandible pressure medium means 34 are disposed in the slotted portions 33 to have contact with the tape winding spools 35 (FIGS. 1, 2, 8) which are disposed in rows aligned relative to the flexible pressure means tubes 34, along a longitudinal axis of the mandrel. The terms "spool" and "sleeve" in this specification and claims refer to and cover spools and sleeves of generally circular or other expansible cross-section, on which tape winding cores may be positioned; such spools and sleeves may be made of plastic or other suitable material and may be of circular or other cross-section and may be of core registration form (90, FIG. 14) or of generally uninterrupted tubular form (89, FIG. 3) or in the form of an elongated spring (98, FIG. 12) of spiral helical (FIG. 12) or other form, suitable for registration and contacting location intermediate (FIGS. 1, 2, 15) the tape winding cores and the bladders or tubes 34.

The tape winding spools alignment means may comprise, for example, spool alignment rods 39 (FIGS. 1, 2, 8, 12–15) on which the spools are assembled in line in the mandrel. The rods are positioned in openings 43 (FIG. 14) in the spools, preferably substantially larger than the cross-sections of the alignment rods (FIGS. 8, 13, 15) the spools being in contact with the flexible tubes 34, enabling each tape winding core 87, 88 (FIGS. 1, 2) to slip independently thereon relative to adjacent or other cores to the degree appropriate to the caliper of the tape-spool-core rewound. The journal 65 shown in FIG. 1 is slotted as at 82 (FIGS. 4 and 5) on its periphery to allow the rod end or rod end and short spacer or sleeve 35*a* thereon to drop into the slot 82 (FIG. 1).

In the preferred procedure just described, the rod 39 with the row of sleeves 35 assembled thereon is first inserted at an angle—for example, about a 30° angle from right to left, and all the spools are allowed to enter slotted axial portion 33 (FIG. 1) of the mandrel, as so disposed on the rod.

Pursuant to the invention the diameter of openings 43 (FIGS. 8, 14) of the tape winding spools is substantially greater than the diameter of the spool alignment rods, whereby the tape winding spools vertically freely float on the rods.

The tape winding spools of each row, when positioned as above described, in the mandrel slotted portion 33, are held against movement on the mandrel by registration means such as "garter" springs 40 (FIGS. 1–3, 8) positioned in circumferentially recessed portions 41 in the mandrel body and readily insertable into and removable from said recessed portions 41.

Figure 2:
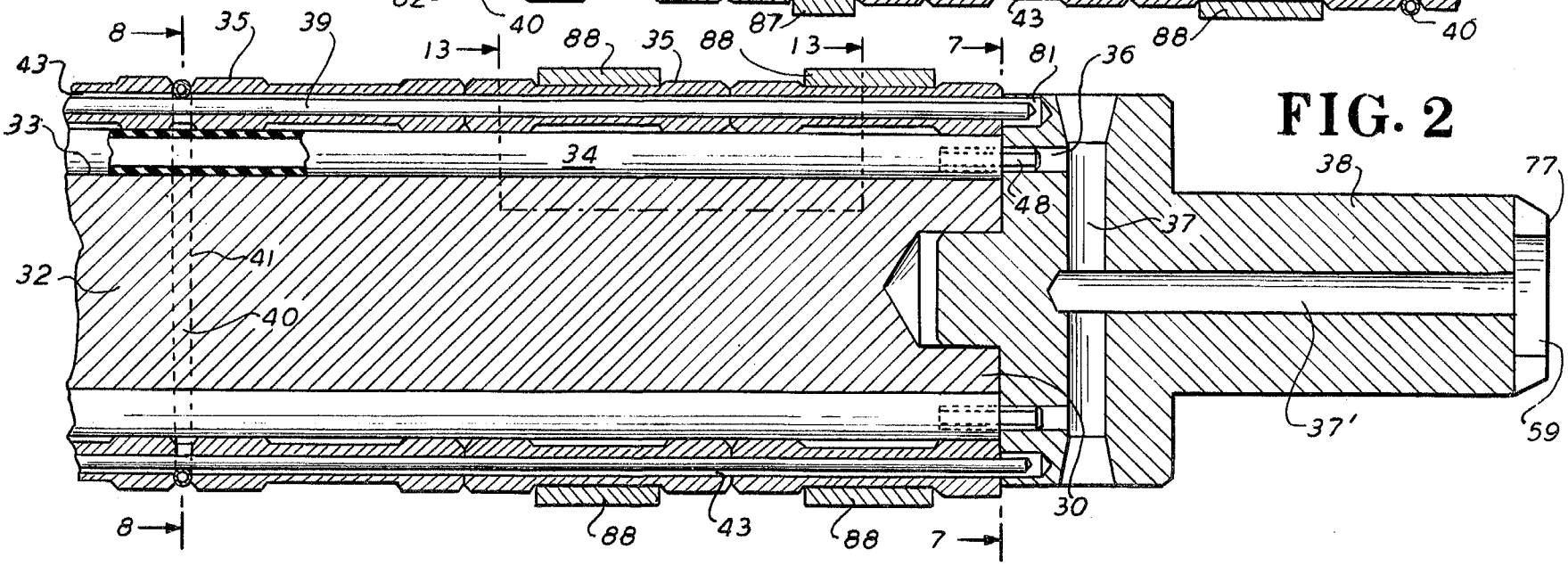
FIG. 2 is a similar view of the other end portion thereof.
Figure 3:
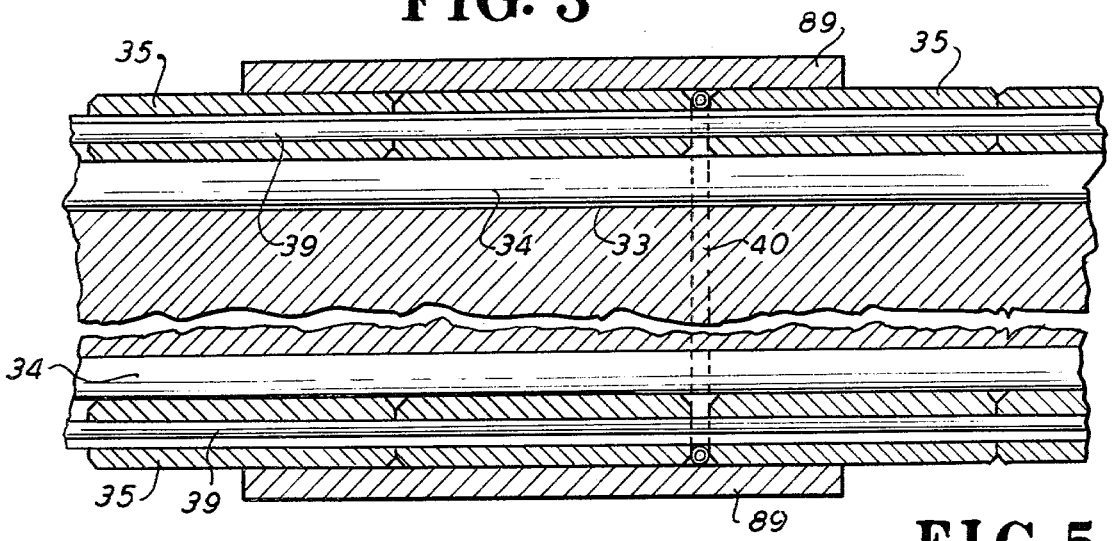
FIG. 3 is a fragmentary medial sectional view of the mandrel, showing an elongated, large core positioned on a plurality of core mounting sleeves.

Before the garter springs 40 are placed on the mandrel, each row of spools 35 is placed on its aligning rod 39 and can move up against the C-clip 80 at the pointed end of the rod (FIG. 11*a*); at the other end of the head of the assembly, a short length of the rod will be exposed. The rod and spool assembly is placed in the axial mandrel slot 33 and then moved ahead inwardly to enter the pointed end 78 of the rod into the rod-capturing recess 81 in journal 38 (FIG. 2).

The rod when so captured at one end at recess 81 and the other end of the rod moving into the slot 82 (FIG. 1) the rod-spool assembly is in place. When a rod and its row of spools is thus captured into the mandrel, a garter spring 40 is applied. Where, as in the drawings exemplarily, there are four rods, each with its row of spools, each assembly is moved as above described; after all of the assemblies are so in place, the garter spring 40 (FIGS. 1, 2) is circumferentially positioned and closed into the groove or recess 41 provided therefor in the mandrel and in the journal 65 for spacing each group of spools spacing desired.

Thus the garter springs, proceeding toward (FIGS. 1, 2) the right, capture the spools in the first row or group section and then the next group and so on along the axis of the mandrel; thus, all of the spools are prevented from moving laterally axially along the mandrel. The springs 40 constitute stop means on the mandrel calculated to be aligned with the end spools of a line of spools, securing them against axial movement on the mandrel. The garter springs are lengths of spiral flexible springs having, at their ends, complementary interlatching engagement; when the springs are positioned in the mandrel slots 40 and the spring ends are interengaged (FIGS. 8, 1, 2) the springs form stop members. The core holding spools 35 are thus aligned on the mandrel in contacting registry with the pressure medium tube 34 means in the slotted portions 33 of the mandrel.

As above recited, each spool 35 is thus vertically movable on rod 35 independently of the position of the adjacent or other spools of the row, whereby the tapes wind onto each spool under uniform tension, notwithstanding variations in dimensions of windings of contiguous or other tapes—for example, varying thicknesses of the tapes due to humidity and other manufacturing differences in the individual tape strips, and variations of caliper of the tapes and cores.

The pressure medium means 34 of the invention may, as shown in the drawings (FIGS. 1-3, 8, 13, 15) comprise elongated inflatable flexible and/or expansible tubes 34, made of any suitable material, such as rubber, positioned in the inward portions of the slots 33, the rows or lines of tape winding spools 35 being, as above noted, positioned on said pressure medium means 34. The spools 35 (FIGS. 8 and 15) preferably extend slightly outwardly of the mandrel.

Figure 8:
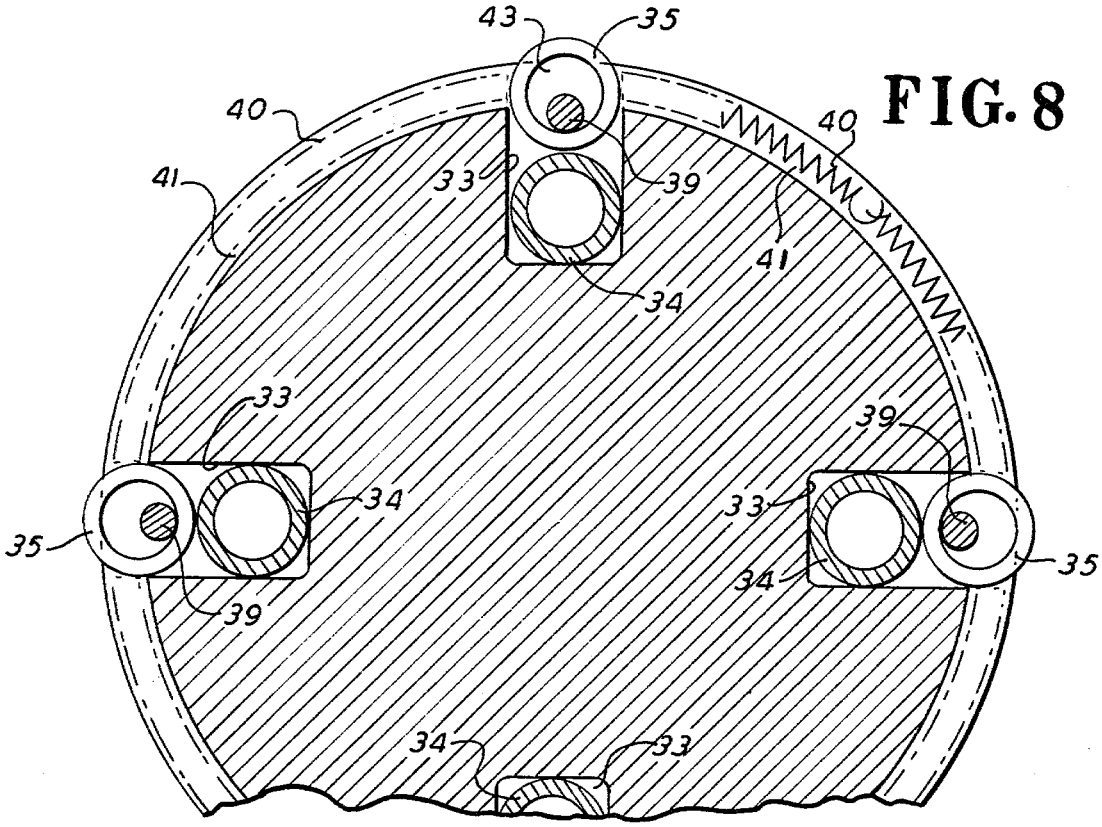
FIG. 8 is an enlarged vertical sectional, partly fragmentary, view taken at line 8—8 of FIG. 2.

The tubes 34 are preferably formed to inflate to circular form (FIGS. 1, 2, 8). Core holding sleeves 35 (FIGS. 1, 2) are preferably likewise formed of circular cross-section, for complementary pneumatic contact with said tubes in carrying out the invention.

The tubes 34 (FIG. 8) are disposed at the inner ends of slots 33 formed radially longitudinally in the mandrel; the sleeves 35 are positioned on the tubes 34 in the slots 33 in the mandrel and preferably extend slightly beyond the open ends of slots; the tape winding cores 87, 88 (FIGS. 1, 2) 89 (FIG. 3) are positioned on sleeves 35. The slotted portions 33 of the mandrel are formed with closed ends in the mandrel (FIG. 8) and with opposite ends opening circumferentially of the mandrel. The pressure medium means may comprise, as noted, an elongated flexible tube 34 positioned on the inner end of the slotted portion 33 of the mandrel, and the core holding spools 35 are (FIGS. 1, 2, 15) positioned atop the flexible tube 35 and extend beyond the open end of the slotted portion 33 of the mandrel.

The inflatable pressure medium tubes 34 are preferably closed at one end (FIG. 1) by suitable means such as closure plugs 45. The other ends of the inflatable flexible tubes 34 may be reinforced as by external metallic or other sleeves or ferrules 46, 46' (FIG. 11) and provided with an internal tubular connector or stud 48 (FIGS. 2 and 11) insertable into air passageway 36 (FIGS. 2 and 6) of air intake journal 38 (FIGS. 2, 6) which is bolted or otherwise secured to the air intake end of the mandrel by suitable means, such as by bolts 44 (FIG. 7) positioned in registration openings 49 (FIGS. 5, 7), of the air intake journal 38 and threaded into internally threaded recesses 50 (FIG. 6) of the air intake end of the mandrel body 32.

Figure 4:
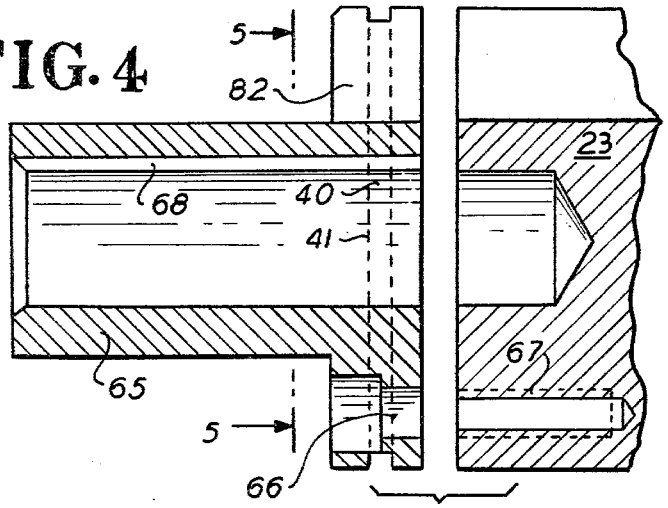
FIG. 4 is a partly fragmentary, vertical sectional view of the end of the mandrel shown in FIG. 1, also showing a splining journal to be secured thereto.
Figure 5:
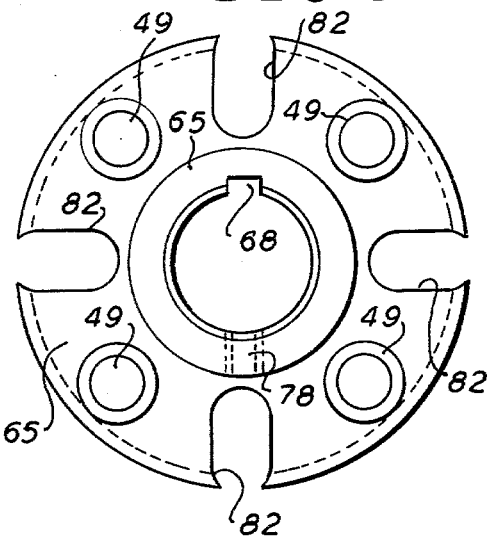
FIG. 5 is a partly fragmentary, vertical sectional view thereof, taken at line 5—5 of FIG. 4.

Mandrel 32 may be installed in the rewinding machine and rotated by any suitable means; for example (FIG. 1) journal 65 may be secured to one end of the mandrel, as by bolt means, such as 44 (FIG. 7) positioned in bolt-receiving socket 66 (FIG. 4) in the journal 65, said bolts being threaded into the threaded apertures 67 in the mandrel (FIG. 4). The journal 65 may include a hub having a longitudinal keyway 68, to receive a splining member 79 (FIG. 1) movable in the hub; a key 69 carried by journal 65, guides the spline in aligned longitudinal movement relative to the keyway. A screw 78 (FIGS. 1 and 5) locks spline member 79 in the keyway 68, at the desired position.

Figure 9:
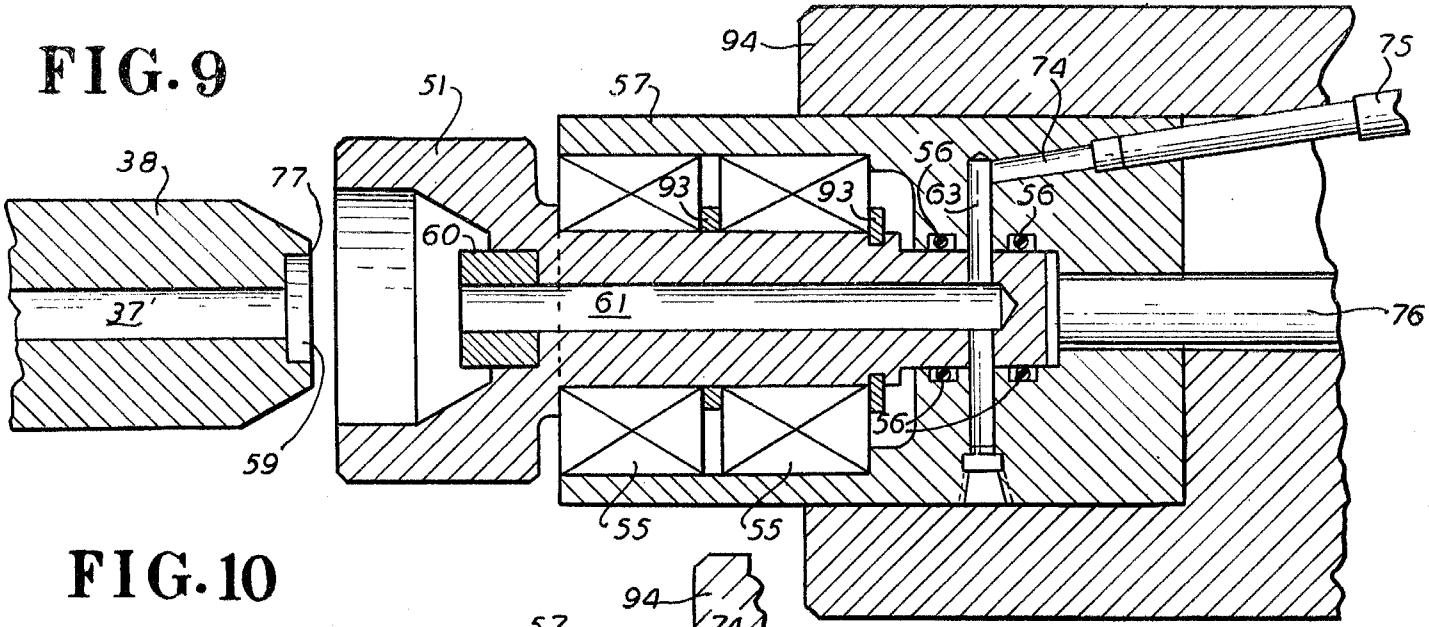
FIG. 9 is a vertical elevational, partly sectional, view of the air intake journal, and an air injector unit to be selectively engaged to and disengaged therefrom.
Figure 10:
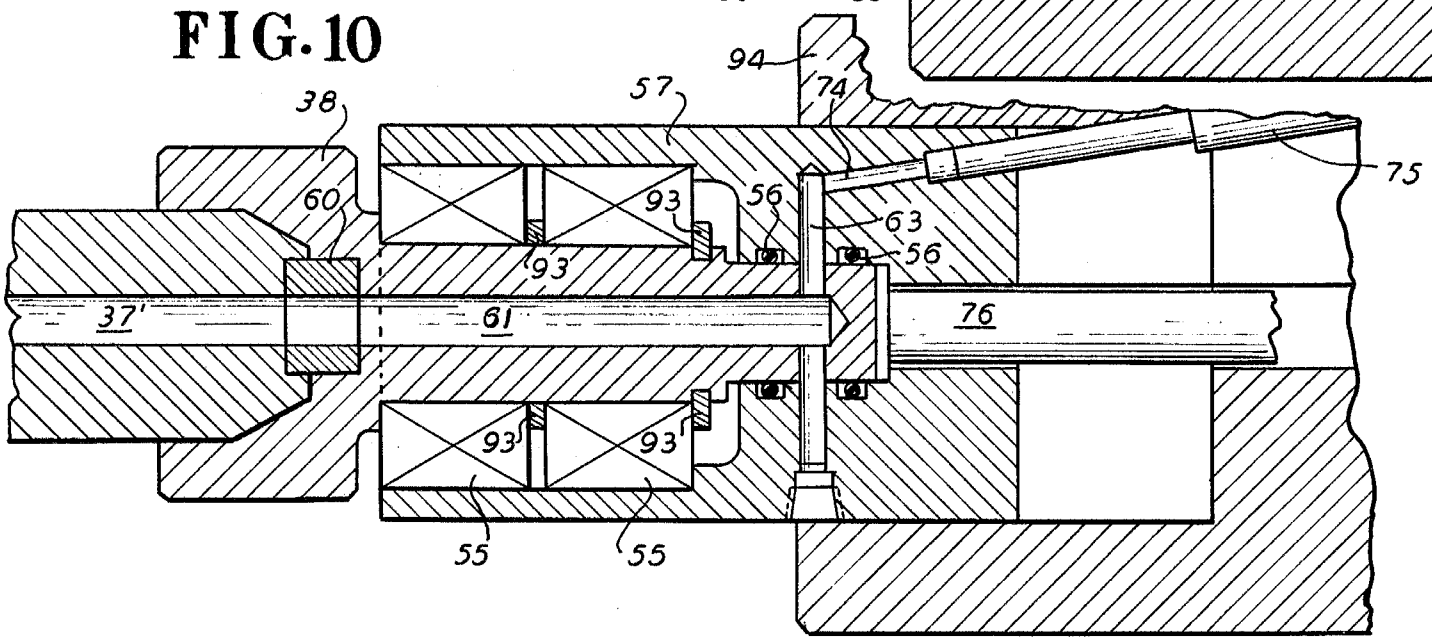
FIG. 10 is a similar view, showing the air injector unit moved to a closing or engaging position onto the air intake journal.

An air injector joiner unit 51 is (FIG. 9) movably (preferably rotatably) positioned in casing 57 for actuation by suitable means such as by compressed air or rod plunger 76 which, when actuated, moves air injection port or opening 61 from FIG. 9 to FIG. 10 position into closing registration with the air intake passageway 37' (FIGS. 9, 10) of air intake journal 38 and thence through air passageways 37 and 36 (FIG. 2) to the pressure medium tubes 34.

Figure 6:
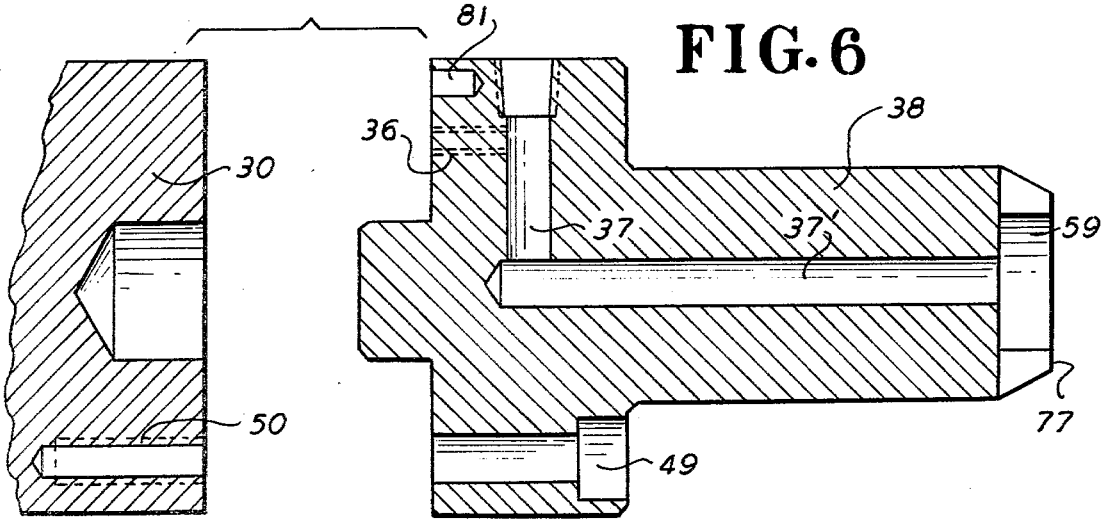
FIG. 6 is a fragmentary vertical sectional view of the air intake end of the mandrel, also showing an air injector journal to be secured thereto.
Figure 7:
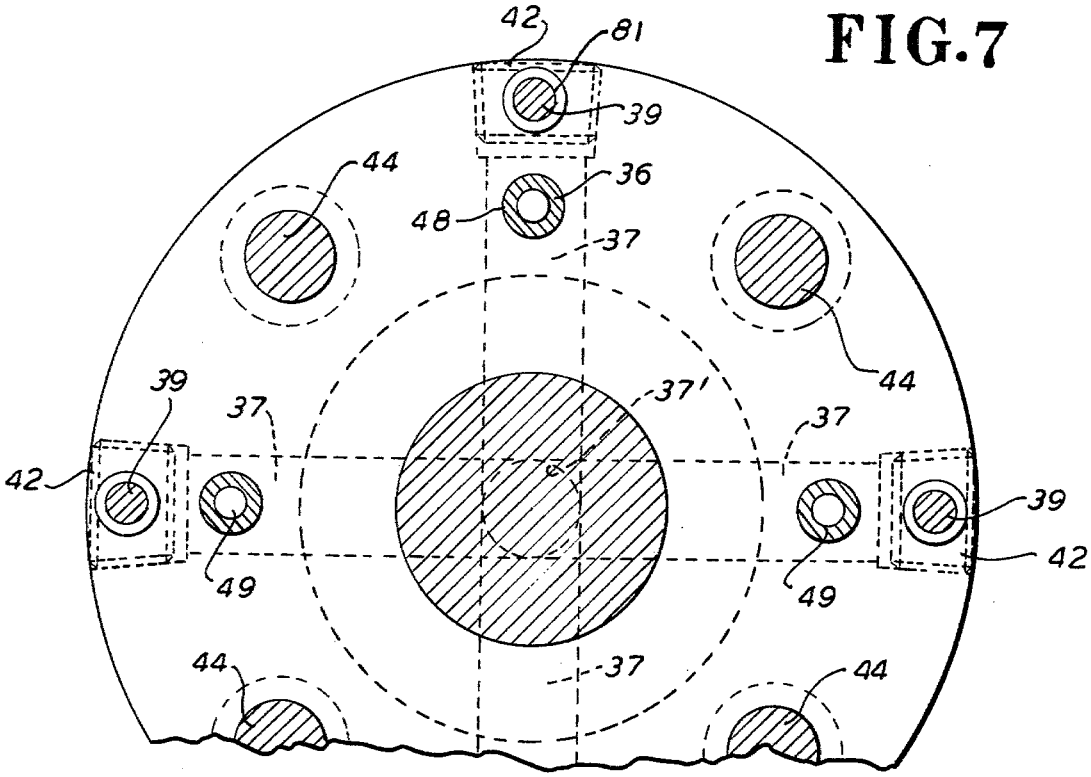
FIG. 7 is an enlarged vertical sectional, partly fragmentary, view taken at line 7—7 of FIG. 2.

An air seal 60 (FIG. 9) is carried by the air injector unit 51 for complementary engagement (FIG. 10) with recess 59 (FIG. 9) at the air intake free end of recess 77 (FIG. 2) of the air intake mandrel journal 38 (FIGS. 2, 6).

Anti-friction means such as 55 (FIG. 10) and air seals 56 are provided in air injector unit 51 (FIG. 9). A suitable compressed air supply source and valve means are connected to an air intake tube 75, which may be of telescopic or otherwise extensible form for connection to a compressor source through a control valve to valve compressed air to air port 63 (FIGS. 9, 10) or other suitable means connecting the air supply source 75 to air port 61 of air injector unit 51.

Referring to FIG. 1, journal 65 may be secured at the desired position against movement by screw 78 engaging the splining member 79 at right angles and locking it in place at the desired position. The splining member 79 (FIG. 1) may have an outwardly extending end 71 which may be splined, complementarily engaging a driving member in the machine wherein the mandrel is to be positioned. By this means the mandrel may be readily used to retrofit machines of various types, originally intended for use with other rewinding mandrels and equipment, as well as to be positioned in new machines driving the mandrel.

A dowel 72 (FIG. 1) may be positioned in the axial opening 73 in journal 65 to further strengthen and stabilize the spline portion of the structure.

The air intake journal 38 (FIGS. 2 and 6) transmits air to the flexible tubes 34 (which are placed in the mandrel as an assembly, and are left therein) from any suitable compressed air source, which may be valve controlled. The source may, exemplarily be (FIGS. 9 and 10) be a compressed air injector joiner 51, having an air port 61 to which compressed air is introduced from any desired external source such as through air port 63 opening into the air port 61 and to which an air supply tube 74 is connected, the other end 75 of supply tube 74 being telescopically or otherwise connected to a compressed air source. The air port 63 may be drilled into or otherwise formed in casing 57 and closed at one end by plug 42' (FIG. 10). The injector unit 51 is preferably journalled in the casing 57 which is movably disposed in machine housing 94, casing 57 being actuated by suitable means such as an air compressor cylinder plunger or rod 76. Anti-friction means such as schematically indicated at 55 are preferably disposed in aligned position and sealed position by means 93 with further air sealing means 56 between air injector 51 and casing 57.

On entry (FIG. 10) of the air seal 60 of the air injector unit into the recessed portion 59 (FIG. 9) of air intake journal 38, compressed air will flow (FIGS. 10, 6) through air ports 61, 37', 37, and through connectors 48 (FIG. 2) to the flexible tubes 34. The injector unit 51 rotates with the mandrel on rotation of the latter, pursuant to the pressure exerted by rod 76 and associated parts.

As above noted, the mandrel (FIG. 7) is provided with radial air passages 37, each threaded at its end to receive a pipe plug 42 to effectuate a seal and being provided with longitudinal axial slots or bore openings 33 (FIG. 1) receiving the flexible long tubes 34 expanded on introduction thereinto of compressed air from air source such as injector 51 when closed (FIG. 10) onto one end of the mandrel. A valve, manually or otherwise controlled, may be cut into the compressed air line source for the air injection unit, whereby the degree of pressure of air introduced into the tubes may be readily controlled. The core-mounting sleeves 35 may be of plastic or other material, and FIG. 8 are positioned in the slots 33 in the mandrel 32 contiguously to and in registration contact with the tubes 34. The tubes are held in axial line rows by "O"-springs 40 partially positioned in circumferential recesses 41 in the mandrel. The tubes, when inflated, expand and press against the sleeves on which the tape loading cores are positioned, automatically tensioning the cores mounted on the sleeves proportional to the resistance of the cores against rotation in the rewinding operation, pursuant to the invention.

The mandrel may be rotated for the rewinding operations by driving means connected thereto or by being coupled to a rotating shaft or other rotating means in a machine wherein the mandrel is positioned, as by connecting the extended end 71 (FIG. 1) of spline member 79 thereto or otherwise connecting the same. The air injector unit 51 may be retracted to its FIG. 9 position to insert the mandrel into the machine or to remove it therefrom.

FURTHER FEATURES AND ADVANTAGES OF THE PRESENT INVENTION

Caliper variation is, as above noted, one of the problems encountered in the art of rewinding of tapes. A roll of web source material 20 (FIG. 16) if manufactured in an atmosphere of substantial humidity not properly controlled, may result in an end product having a great deal of rippling, indicating differences in thickness in the area having ripples. Humidity effects also occur in the process of the manufacturing without proper control of the gauge of the material; materials so made are usually appreciably off caliper. If one tape being rewound is of constant and normal thickness and adjacent or other tapes on the mandrel are not, because of ripples therein or, for any other reason, there are variations in thickness from tape to tape. The present invention assures that the torque transmitting tension, being a function of the inside of the core, the outside of the mandrel and the amount of air pressure for each core, will automatically be the same. Hence, pursuant to the procedures of the present invention, the torque on all cores will be the same, regardless of the condition of the tape material.

As the spools 35 on the various cores along the mandrel (FIGS. 1, 2) are not attached to the mandrel, they can each move independently of the others due to their "free floating" mounting on the rods 39 and their contact with the flexible pressure means 34—important further features of the present invention.

It is often desirable to slit tapes of different widths on the same mandrel. Conventional mandrel systems did not achieve this objective while applying equal tension to each strip; the present invention achieves this readily and efficiently by enabling an infinite number of different slit tape widths to be rewound on cores on sleeves, of different lengths (FIG. 1) on the same mandrel, with each different core, for further example 87, 88 (FIG. 1) receiving the desired torque required by it; likewise (FIG. 3) a single wide core 89 may be positioned on a plurality of tape winding spools.

The invention is further especially useful in rewinding tapes having gauges that are off caliper, such as pressure sensitive and other tapes whose caliper is hard to control—for example, where ripples caused in sections of a mill roll are present in the tapes or where there are visible bumps in the mill roll so that short sections thereof (and thus in the tape portions slit therefrom) are slightly thicker. In slitting and rewinding such roll, thicker sections of the web material, when slit to tape form, and rewound, would cause the cores whereon they are rewound to slip more than those whereon adjacent uniform portions of the source web (and thus of tapes slit therefrom) are rewound. Caliper variations also often occur in cases of laminated material or any other material that has been coated—for example adhesive-coated film, or paper laminated to another product such as printing film; in laminated mill rolls, where there is printing along the surface, the web source would be thicker in the areas laminated; where printing ink has been applied the same condition occurs. The mandrel of the present invention automatically differentially rewinds tapes with relation to the specific torque requirements of each tape as encountered in the rewinding procedure.

Preferred embodiments of the invention have been set forth above. It is to be understood, however, that variations may be made in such preferred embodiments, which are within the scope and spirit of the invention. The invention is therefore to be broadly construed within the scope and spirit of the claims herein.

I claim:

1. A differential mandrel for rewinding tapes, from a source, onto a mandrel, on rotation of said mandrel, comprising:

(a) an elongated mandrel body member, (b) a slotted portion formed therein and opening circumferentially outwardly thereof, (c) said slotted portion extending axially along a substantial portion of the mandrel body, and having a closed inner end;

(d) flexible, elastic elongated tubular pressure medium means disposed on the inner end of said slotted portion of the mandrel, (e) tape winding spools contiguously disposed on said mandrel relative to said pressure means and in contact therewith, (f) said tape winding spools having axially disposed openings therein, (g) elongated alignment means positioned in said spool openings and aligning said spools in line in a row along the longitudinal axis of the mandrel, (h) said alignment means having a cross sectional dimension substantially smaller than that of the tape winding spools whereby the latter vertically freely float on the alignment means, (i) said alignment means aligning said spools for registration with said pressure means in said mandrel slotted portion of the mandrel, whereby tapes may be wound onto said spools, under constant tension, on rotation of the mandrel, notwithstanding caliper variations in the tapes.

2. In a differential mandrel for rewinding tapes, from a source, onto spools on said mandrel, on rotation of said mandrel, as set forth in claim 1:

stop means on said mandrel, engaging said spools and locating them against longitudinal axial movement on the mandrel.

3. In a differential mandrel for rewinding tapes, from a source, onto said mandrel, on rotation of said mandrel, as set forth in claim 1:

said mandrel having further slotted portions formed circumferentially therein, stop means on said mandrel and extending therefrom, and said stop means being positioning partially in said further slotted portions and partially extending therefrom and so securing said spools against longitudinal axial movement on the mandrel.

4. In a differential mandrel for rewinding tapes, from a source, onto said mandrel, on rotation of said mandrel, as set forth in claim 1:

a further slotted portion formed in said mandrel in parallel spaced relation to the first mentioned slotted portion, and opening circumferentially outwardly thereof, further pressure medium means connectable to said further slotted portion, further tape winding spools contiguously disposed on said mandrel, aligning means engaging the mandrel and positioning said further spools in alignment on said mandrel in contact with said further pressure means, said means so aligning the further spools on the mandrel in contacting registry with the further pressure means in the further slotted portion of the mandrel, whereby tapes may be wound onto said spools, under constant tension, notwithstanding caliper variations in the tapes.

5. In a differential mandrel for rewinding tapes from a source onto said mandrel, on rotation of said mandrel, as set forth in claim 1:

said pressure medium means comprising an elongated flexible tube positioned in said slotted portion of mandrel and contacting said spools, and further comprising a pressure medium source so connectable to said tube so positioned in said mandrel slotted portion.

6. In a differential mandrel for rewinding tapes from a source, onto said mandrel, on rotation of said mandrel, as set forth in claim 1:

said pressure medium means comprising pneumatic pressure means.

7. In a differential mandrel for rewinding tapes from a source, onto said mandrel, on rotation of said mandrel, as set forth in claim 1:

said pressure medium means including a pneumatically inflatable elongated tube positioned in said slotted portion of said mandrel, said pressure means further comprising pneumatic pressure means, said tube being closed at one end and open at the other end, and being connectable at its said open end to said pneumatic pressure means, whereby said tube may be expanded by said pneumatic pressure means into contacting relation to said spools, and whereby each of said spools will be in contact with said tube under uniform tension, notwithstanding caliper variations in said tapes.

8. In a differential mandrel for rewinding tapes, from a source, onto said mandrel, on rotation of said mandrel, as set forth in claim 1:

said spool alignment means comprising a spool alignment rod, said spools being provided with means receiving said alignment rod, thereby so positioning said spools in line on said mandrel.

9. In a differential mandrel for rewinding tapes from a source, onto said mandrel, on rotation of said mandrel, as set forth in claim 1:

said spool alignment means comprising a spool alignment rod engaging the mandrel, said spools being provided with axial openings therethrough, receiving said alignment rod and so positioning said spools in line on said mandrel.

10. In a differential mandrel for rewinding tapes, from a source, onto said mandrel, on rotation of said mandrel, as set forth in claim 1:

said spool alignment means comprising a spool alignment rod, said spools being provided with rod-receiving openings positioning said spools in line on said rod, said openings in the spools being larger than the cross-sectional dimensions of the rod, whereby said spools are independently floatingly positioned on the rod, whereby each spool may move on the rod under uniform tension and independently of the other spools on the rod, notwithstanding caliper variations in the tapes.

11. In a differential mandrel for rewinding tapes, from a source, onto said mandrel, on rotation of said mandrel, as set forth in claim 1;

said spools having tape core registration portions thereon, and tape cores positioned on said registration portions.

12. In a differential mandrel for rewinding tapes, from a source, onto said mandrel, on rotation of said mandrel, as set forth in claim 1:

an elongated flexible tube comprising said pressure medium means positioned in said slotted portion of mandrel in contact with said spool, and said pressure medium means being connectable to said tube so positioned in said mandrel opening.

13. In a differential mandrel for rewinding tapes, from a source, onto said mandrel, on rotation of said mandrel, as set forth in claim 1:

a pneumatically inflatable elongated tube positioned in said slotted portion of said mandrel, said pressure means being pneumatic pressure means connected to said tube.

14. In a differential mandrel for rewinding tapes, from a source, onto said mandrel, on rotation of said mandrel, as set forth in claim 1:

a pneumatically inflatable elongated tube positioned in said slotted portion of said mandrel, and contacted by said spools, said presure means being pneumatic pressure means, said spools having circular end portions for engaging said tube, and having medial portions for receiving tape cores thereon.

15. In a differential mandrel for rewinding tapes, from a source, onto said mandrel, on rotation of said mandrel, as set forth in claim 1:

a pneumatically inflatable elongated tube positioned in said slotted portion of said mandrel, said pressure means being pneumatic pressure means, said spools having offset end portions for engaging said tubes, and having medial portions for receiving tape cores thereon.

16. In a differential mandrel for rewinding tapes, from a source, onto said mandrel, on rotation of said mandrel, as set forth in claim 1:

said slotted portion of the mandrel being so formed with said closed end in the mandrel and being further formed with an opposite open end opening circumferentially of the mandrel, said pressure medium means comprising an elongated flexible tube positioned on the inner end of the slotted portion of the mandrel, and said spools being so positioned atop said flexible tube and extending to the open end of the slotted portion of the mandrel.

17. In a differential mandrel for rewinding tapes, from a source, onto said mandrel, on rotation of said mandrel, as set forth in claim 1:

said slotted portion of the mandrel being of elongated U-shape cross-sectional form.

18. A differential mandrel for rewinding tapes, from a source, onto said mandrel, on rotation of said mandrel, comprising:

(a) an elongated mandrel body member, (b) a plurality of slotted portions formed axially therein in spaced parallel relation, and formed equidistantly spaced circumferentially therein and coextensive with the length of the mandrel opening outwardly of the same circumferentially thereof, (c) flexible pressure medium means connectable to said slotted portions, (d) tubular, elongated tape winding spools contiguously disposed on said mandrel, in contact with said flexible pressure medium means, (e) an elongated rod positioned in said spools and disposing them in alignment on said mandrel, (f) said rod so aligning the spools on the mandrel in contacting registry with said pressure medium means in said slotted portions of the mandrel, whereby tapes will be wound onto said spools on rotation of the mandrel under uniform tension, notwithstanding caliper variations in the tapes.

19. In a differential mandrel for rewinding tapes, from a source, onto said mandrel, on rotation of said mandrel, as set forth in claim 18:

stop means on said mandrel aligned with the end spools and securing them against axial movement on the mandrel.

20. In a differential mandrel for rewinding tapes from a source onto spools on said mandrel, on movement of said mandrel, as set forth in claim 18:

said spools being made of relatively harder material than said elongated tubes.

21. In a differential mandrel for rewinding tapes, from a source, onto said mandrel, on rotation of said mandrel, as set forth in claim 18:

said alignment rod independently so movably positioning the spools on the mandrel perpendicularly to the longitudinal axis of the mandrel, whereby each spool may move perpendicularly independently of the position of other spools as the tapes are wound on the respective spools.

22. In a differential mandrel for rewinding tapes, from a source, onto said mandrel, on rotation of said mandrel, as set forth in claim 18:

said spools being provided with axial openings therethrough, receiving said rod and positioning said spools in row alignment on said mandrel, and in line with the pressure medium means in said slotted portions of the mandrel, said spools having said axial openings larger than the cross-sectional dimensions of the rod, whereby said spools are independently floatingly positioned on the rod, enabling each spool to move on the rod independently of the position of other spools on the rod, responsive to caliper variations in the tapes so wound thereon.

23. In a differential mandrel for rewinding tapes from a source, onto said mandrel, on rotation of said mandrel, as set forth in claim 18:

said pressure medium means comprising pneumatic pressure means.

24. In a differential mandrel for rewinding tapes from a source onto said mandrel, on rotation of said mandrel, as set forth in claim 18:

said pressure medium means comprising elongated flexible tubes positioned in said slotted portions of mandrel, contacting said spools, and tube inflating means connectable to said tubes so positioned in said mandrel slots, to inflate them, to be pneumatically contacted by said spools.

25. In a differential mandrel for rewinding tapes from a source, onto said mandrel, on rotation of said mandrel, as set forth in claim 18:

said pressure medium means including pneumatic pressure means, and further including pneumatically inflatable elongated tubes positioned in said slotted portions of said mandrel and inflatable by said pressure means, whereby said tubes may be pneumatically inflated and expanded in said slotted portions of the mandrel in contact with said spools, and whereby said spools will be in contact with said tubes under constant pressure notwithstanding variations in said tapes.

26. In a differential mandrel for rewinding tapes from a source onto said mandrel, on rotation of said mandrel, as set forth in claim 18:

said pressure medium means including an air duct provided in said mandrel, in communication with said slotted portion and with one end of the mandrel.

27. In a differential mandrel for rewinding tapes from a source onto said mandrel, on rotation of said mandrel, as set forth in claim 18:

said pressure medium means including an air duct provided in said mandrel, in communication with said slotted portion and with one end of the mandrel, and an air injection journal secured to said one end of the mandrel in registration with said air duct so provided in said mandrel.

28. In a differential mandrel for rewinding tapes, from a source, onto said mandrel, on rotation of said mandrel, as set forth in claim 18, means closing said flexible pressure medium means at one end of said mandrel, a journal secured to said one end of the mandrel and provided with slotted portions registering with the slotted portions at said one end of the mandrel, and means on said journal for connecting said one end of the mandrel with means for so rotating the mandrel.

29. In a differential mandrel for rewinding tapes from a source onto said mandrel, on rotation of said mandrel, as set forth in claim 18:

said pressure medium means including an air duct provided in said mandrel, in communication with said slotted portion and with one end of the mandrel, an air injection journal secured to said one end of the mandrel in registration with said air duct so provided in said mandrel, means closing said flexible pressure medium means at the other end of said mandrel, a journal secured to said other end of the mandrel and provided with slotted portions registering with the slotted portions at said one end of the mandrel, and means on said journal for connecting said other end of the mandrel with means for so rotating the mandrel.

30. In a differential mandrel for rewinding tapes from a source onto spools on said mandrel, on rotation of said mandrel, as set forth in claim 18:

said tape winding spools comprising spring members so disposed on said mandrel in contact with said flexible pressure means.

31. In a differential mandrel for rewinding tapes from a source onto spools on said mandrel, on rotation of said mandrel, as set forth in claim 18:

said tape winding spools comprising elongated spring members so disposed on said mandrel in contact with said flexible pressure means.

32. In a differential mandrel for rewinding tapes from a source onto spools on said mandrel, on rotation of said mandrel, as set forth in claim 18:

said tape winding spools comprising elongated helical spring members so disposed on said mandrel in contact with said flexible pressure means.

33. A differential mandrel for rewinding tapes, from a source, onto said mandrel, on rotation of the mandrel, comprising:

(a) an elongated mandrel body member, (b) a slotted portion formed therein and opening circumferentially outwardly thereof, (c) pressure medium means disposed on the inner end of said slotted portion of the mandrel, (d) a tape-winding member disposed on the mandrel relative to the pressure medium means and in contact therewith, (e) said tape-winding member having an axially disposed aperture therethrough, (f) an elongated rod member of greater length than the tape-winding member, (g) said elongated rod member being further of smaller cross-sectional diameter than that of the aperture in said tape-winding member, whereby said axial alignment rod may freely pass through said aperture of the tape-winding member, and the latter may freely move thereon at right angles to its axis, (h) said elongated rod member being positioned through said tape winding member aperture and aligning said tape-winding member with said pressure means in said mandrel, whereby tapes may be wound onto said tape-winding member, under constant tension, on rotation of the mandrel, notwithstanding caliper variations in the tape.

34. A differential mandrel for rewinding tapes, from a source, onto said mandrel, on rotation of the mandrel, comprising:

(a) an elongated mandrel body member, (b) a slotted portion formed circumferentially therein and opening outwardly thereof, (c) flexible pressure medium means disposed on the inner end of said slotted portion of the mandrel, (d) a plurality of tape-winding members disposed on the mandrel, in contiguous relation, and in contact with said pressure medium means, (e) said tape-winding members having axially disposed apertures therethrough, (f) an elongated rod member of greater length than the tape-winding members, (g) said elongated rod member being of smaller cross-sectional diameter than that of the axially disposed apertures of said tape-winding members, whereby said axial alignment rod may freely pass through said apertures of the tape winding members, and the latter may freely move thereon at right angles to its axis, (h) said elongated rod member being further positioned through said tape-winding member apertures and so contiguously aligning said tape winding members with said pressure means in said mandrel, each tape-winding member being thus movable vertically on the rod independently of the position of other tape-winding members on the rod, and whereby tapes may be wound onto said tape-winding members, under constant tension, on rotation of the mandrel, notwithstanding caliper variations in the tapes.

35. A method of differentially rewinding a tape onto a mandrel on rotation of the mandrel, said mandrel being provided with an axially slotted portion opening circumferentially thereof and with expansible pressure means in said slotted portion of the mandrel, said method comprising:

positioning a tape-rewinding member for so rewinding a tape, on said expansible pressure means, said tape-rewinding member having an axial aperture therethrough, positioning an axial alignment rod in said tape-rewinding member through said axial aperture therein, said axial aperture of the tape-rewinding member being of greater cross-sectional diameter than the axial alignment rod, whereby said axial alignment rod may freely pass through said aperture of the tape-rewinding member, and the latter may freely move thereon at right angles to its axis, and expanding said expansible pressure means in said mandrel, thereby exerting pressure on said tape-rewinding member and moving the latter at right angles to the longitudinal axis thereof, to apply the differential torque required by the tape as so rewound thereon on rotation of the mandrel.

36. A method of differentially rewinding tapes onto a mandrel on rotation of the mandrel, said mandrel being provided with axially slotted portions opening circumferentially thereof and with expansible pressure means in said slotted portions of the mandrel, said method comprising:

positioning tape-rewinding members for so rewinding tapes, on said expansible pressure means, said tape-rewinding members having axial apertures therethrough, positioning axial alignment rods in said tape-rewinding members through said axial apertures therein, said axial apertures of the tape-rewinding members being of greater cross-sectional diameter than the axial alignment rods, whereby said axial alignment rods may freely pass through said apertures of the tape-rewinding members and the latter may freely move thereon at right angles to their axes, and extending said expansible pressure means in said mandrel, thereby exerting pressure on said tape-rewinding members and moving the latter at right angles to the longitudinal axes of said tape-rewinding members, to apply the differential torques required by the tapes as so rewound thereon on rotation of the mandrel, each tape-winding member being thus movable vertically on the rod independently of the position of other tape-winding members on the rod.

* * * * *